US007549767B2

(12) United States Patent
Lavergne

(10) Patent No.: US 7,549,767 B2
(45) Date of Patent: Jun. 23, 2009

(54) LUMINAIRE HAVING ROTATABLE LAMPHOLDER SUPPORT

(75) Inventor: Serge Lavergne, La Machine (FR)

(73) Assignee: Koninklijke Philips Electronics N.V., Eindhoven (NL)

( * ) Notice: Subject to any disclaimer, the term of this patent is extended or adjusted under 35 U.S.C. 154(b) by 58 days.

(21) Appl. No.: 10/543,430

(22) PCT Filed: Jan. 21, 2004

(86) PCT No.: PCT/IB2004/000184

§ 371 (c)(1),
(2), (4) Date: Jul. 26, 2005

(87) PCT Pub. No.: WO2004/068030

PCT Pub. Date: Aug. 12, 2004

(65) Prior Publication Data

US 2006/0152934 A1 Jul. 13, 2006

(30) Foreign Application Priority Data

Jan. 29, 2003 (FR) ..... 03 00988

(51) Int. Cl.
*F21V 21/00* (2006.01)
*F21V 19/02* (2006.01)

(52) U.S. Cl. ..... 362/217.16; 362/220

(58) Field of Classification Search ..... 362/225, 362/418, 427, 429, 433, 448, 449, 220, 221, 362/217.13, 217.11, 217.1, 217.14, 217.16; 439/239

See application file for complete search history.

(56) References Cited

U.S. PATENT DOCUMENTS

| | | | | | |
|---|---|---|---|---|---|
| 4,874,320 | A | * | 10/1989 | Freed et al. | 439/115 |
| 4,992,915 | A | * | 2/1991 | Meister | 362/427 |
| 5,038,257 | A | * | 8/1991 | Agabekov | 362/219 |
| 5,521,804 | A | * | 5/1996 | Degelmann et al. | 362/220 |
| 6,024,470 | A | * | 2/2000 | Wang | 362/370 |

FOREIGN PATENT DOCUMENTS

GB 2239085 A * 6/1991

* cited by examiner

*Primary Examiner*—Ismael Negron
*Assistant Examiner*—David R Crowe

(57) ABSTRACT

The present invention relates to a luminaire of elongated shape comprising an elongated mounting-plate (1) carrying internal functional components of the luminaire. The mounting-plate comprises at least one lampholder-supporting tongue (3) that is cut out in the mounting-plate by punching. The tongue remains integrally connected to the plate and is capable of undergoing rotation through 90° from an initial position to an in-use position about a bending axis (7) along which the tongue is connected to the plate. The mounting-plate also comprises an abutment (6), produced by stamping, which enables the rotation of the lampholder-supporting tongue to be limited to approximately 90°.

11 Claims, 2 Drawing Sheets

LUMINAIRE HAVING ROTATABLE LAMPHOLDER SUPPORT

Figure 1:
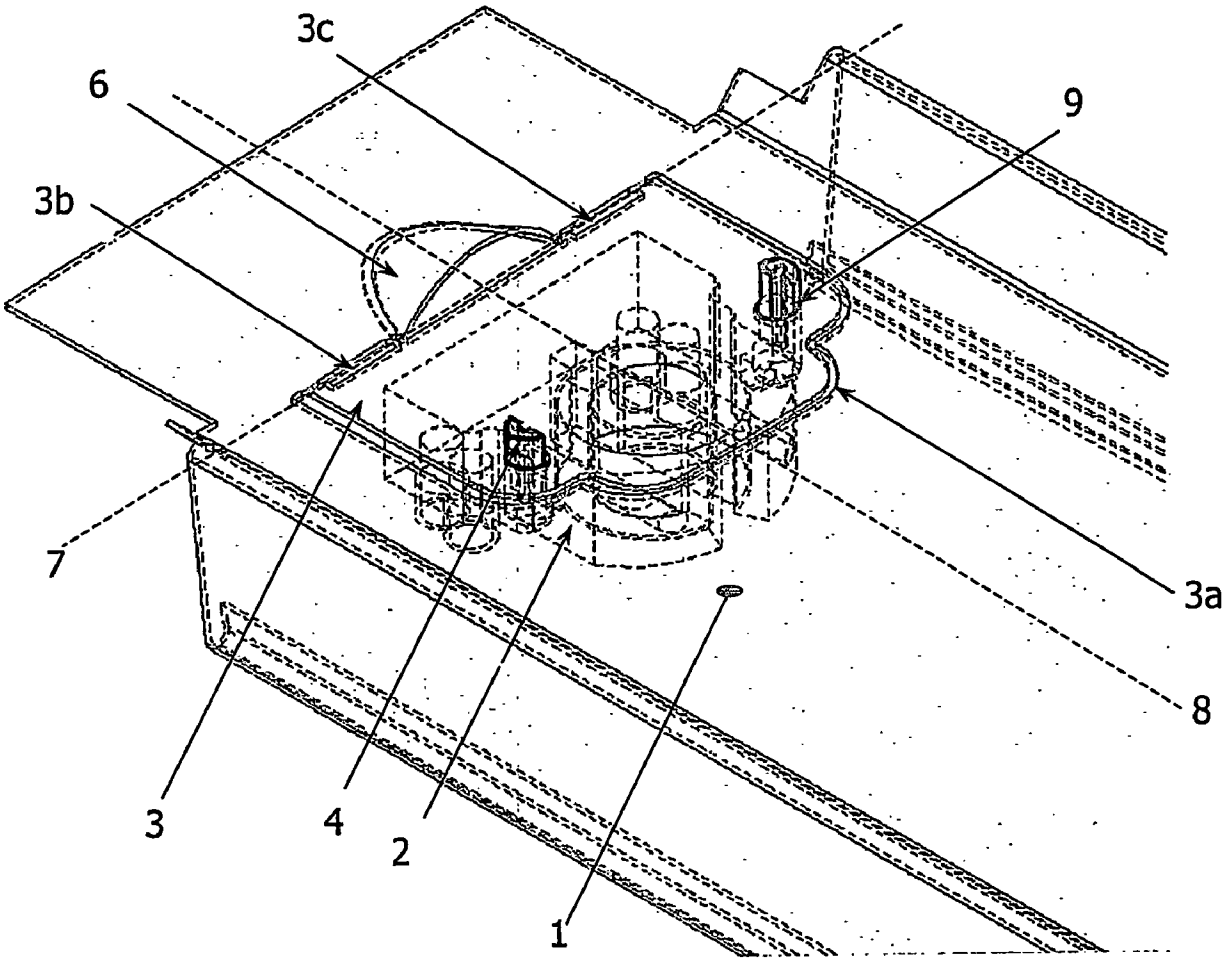

The present invention relates to a luminaire of elongated shape having an elongated mounting-plate supporting the internal functional components of the luminaire.

A conventional luminaire comprises a mounting-plate in which openings are made in such a way that a fitter can insert a pair of lampholders for a fluorescent tube, which lampholders pass through the plate. In a conventional luminaire of this type, the pair of lampholders are fixed through the plate by inserting them on the side opposite to the side to which the electrical wiring for said lampholders is fastened. The luminaire is therefore supplied with the lampholders not fitted; where there is more than one fluorescent tube, a fitter can therefore make a mistake when fixing the lampholders to the mounting-plate because the wiring for the lampholders is not accessible to him. Alternatively, the luminaire is supplied with the lampholders already fitted to the mounting-plate but the package is then of a greater height due to the extra thickness caused by the lampholders.

Document DE 3 423 357 puts forward a solution to this problem. This comprises a lampholder device having a base part and a lampholder. The base part is fixed to the body of the luminaire and the lampholder is mounted to rotate on the base part. In this way, the lampholder is able to perform a rotary movement through approximately 90° from a storage position to an operational position.

However, this solution is particularly complex because it requires an additional component: the base part. There are costs involved in this additional component, on the one hand in terms of price and on the other in terms of fitting time.

It is an object of the present invention to put forward a luminaire as described in the opening paragraph that is of low cost and easy to fit while still being capable of being brought to a state where it is of reduced height for placing in packaging, and that is not conducive to errors when it is subsequently being installed.

To this end, the luminaire according to the invention is characterized in that the mounting-plate comprises at least one lampholder-supporting tongue that is cut out in the mounting-plate, said tongue remaining integrally connected to the mounting-plate and being capable of undergoing rotation from an initial position to an in-use position about a bending axis along which the tongue is connected to the mounting-plate.

The present invention thus does not require an additional component because the lampholder-supporting tongue is an integral part of the mounting-plate.

What is more, the lampholder can be fitted directly to the mounting-plate via the lampholder-supporting tongue. There is thus a reduction in fitting time because, in contrast to the prior art, there is no longer an additional component that has to be fixed to the mounting-plate.

The electrical test on the mounting-plate that is made on the assembly line no longer calls for the lampholders to be set to their in-use position and then returned to their initial positions after the test, because they are situated on the same side as the other functional components that have to be tested.

What is more, the height of the package containing the luminaire is reduced because the lampholder does not add any extra thickness due to the fact that it is situated on the same side as the other functional components and their wiring when the lampholder supporting-tongue is in its initial position.

Finally, the fitter does not have to fit the lampholders but only place the lampholder-supporting tongues in the in-use position and, if he has to wire them up, the wiring for them will be easily accessible to him. It is also open to him to adjust the rotation of the lampholder-supporting tongues in order to match up to the length of the fluorescent tube.

The present invention also relates to a method of producing a mounting-plate for a luminaire of an elongated type.

These and other aspects of the invention are apparent from and will be elucidated with reference to the embodiments described hereinafter, which are given by way of non-limiting example.

Figure 2:
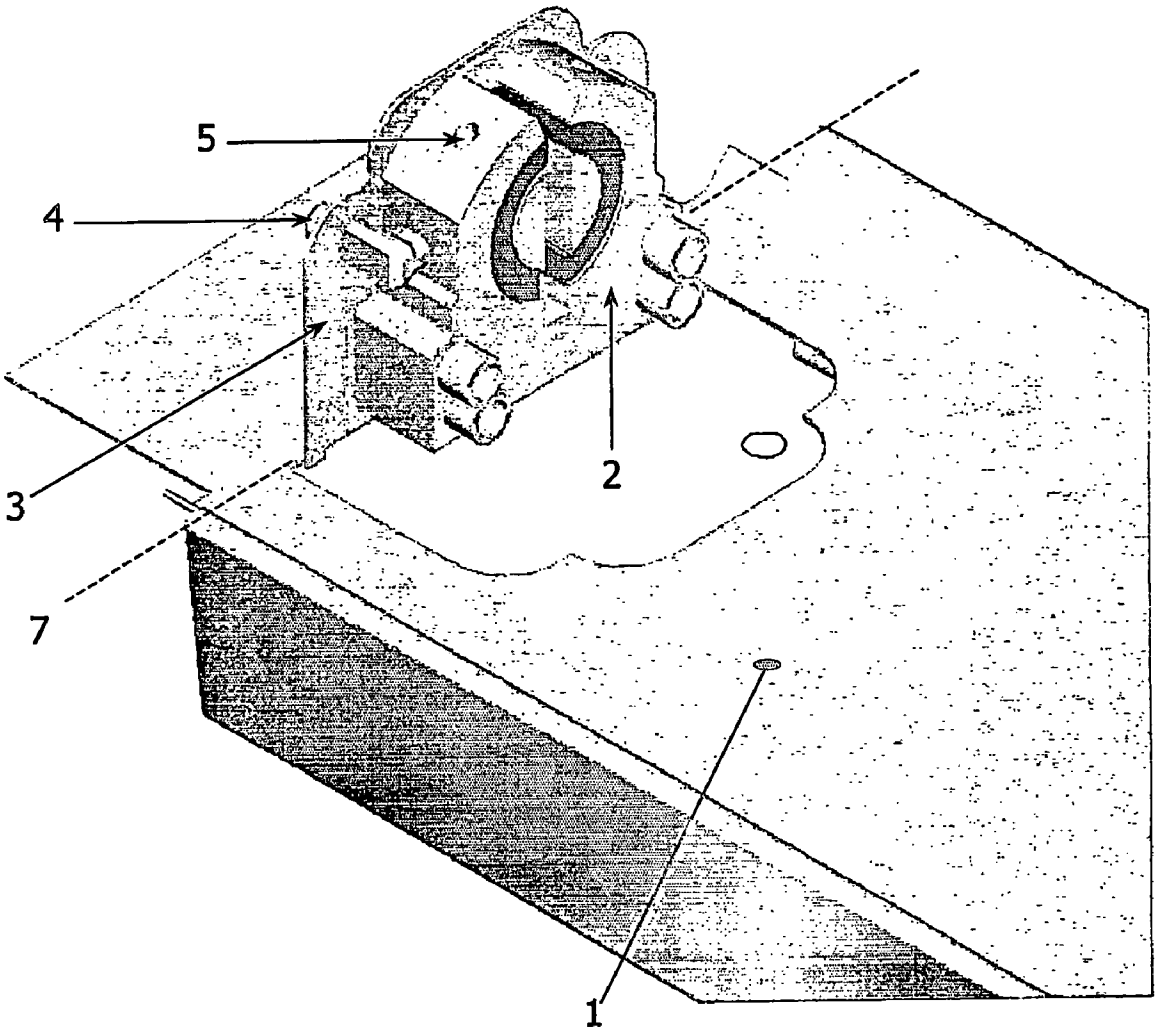

In the drawings:

FIG. 1 is a perspective view of a mounting-plate for a luminaire of an elongated type comprising a lampholder-supporting tongue according to the invention, said tongue being in its initial position, and FIG. 2 is a perspective view of a mounting-plate for a luminaire of an elongated type comprising a lampholder-supporting tongue according to the invention, said tongue being in its in-use position.

The present invention relates principally to low-cost sealed luminaries. It employs standard items of equipment, particularly in respect of the lampholders, which are conventional low-cost lampholders, sometimes called flat lampholders.

A luminaire according to the invention comprises, amongst other things:

- a body comprising a half-shell, termed a "roof", which is equipped with means for fixing it to a support of any kind, such as a ceiling, for example,
- a transparent cover or "diffuser", which can be swung aside to give access to the interior of the luminaire,
- a mounting-plate, made from a piece of profiled or indeed folded sheet metal, which carries internal functional components of the luminaire, these being, amongst other things, a ballast and lampholders for fluorescent tubes.

FIG. 1 is a perspective view of a mounting-plate (1) for a luminaire of an elongated type, comprising a lampholder-supporting tongue (3) according to the invention, said tongue being in its initial position. This position represents a configuration that is suitable:

- for the fitting of components, such as lampholders (2) and ballasts for example, to the mounting-plate,
- for the wiring-up of the components,
- for checking that said components are working properly,
- for storing the mounting-plate, together with the body of the luminaire, in a package to allow it to be transported.

As shown in FIG. 1, the lampholder-supporting tongue (3) is cut out of the sheet metal of the mounting-plate (1). A main cut (3*a*) substantially follows the shape of the lampholder (2). At least one ancillary cut (3*b*, 3*c*) is made along a bending axis (7), in the form of slots for example, the bending axis (7) being substantially perpendicular to the longitudinal axis (8) of the mounting-plate (1). This ancillary cut or these ancillary cuts make it easier for the lampholder-supporting tongue (3) to be rotated by bending on the bending axis (7). The cutting out of the lampholder-supporting tongue is performed by punching according to a principle familiar to the man skilled in the art of luminaires.

The lampholder-supporting tongue contains openings (9) suitable for receiving fixing lugs (4) of the lampholder (2). According to an embodiment of the invention, the lampholders are fixed in place by clipping the fixing lugs through openings (9) made by punching in the lampholder-supporting tongue. Said lugs are for example made of plastic material.

The mounting-plate (1) advantageously comprises an abutment (6), which allows the rotation by bending of the lampholder-supporting tongue (3) to be limited to approximately 90°. This abutment is, for example, centered on the longitudinal axis (8) of the mounting-plate. According to an embodiment of the invention, the abutment is produced by stamping.

FIG. 2 is a perspective view of a mounting-plate (1) for a luminaire of an elongated type comprising a lampholder-supporting tongue (3) according to the invention, said tongue being in an in-use position. In said position, the lampholder-supporting tongue (3) is substantially perpendicular to the mounting-plate (1), said tongue being situated on the non-wired side of the mounting-plate.

When an installer is installing a luminaire, he rotates the lampholder-supporting tongue (3) through 90° by bending. He is then able to fit a fluorescent tube. This may be a fluorescent tube of the T5 or T8 type, for example.

Fluorescent tubes are subject to slight variations in size. The present invention makes possible for the fitter to adjust the rotation of the lampholder-supporting tongue (3) around the 90° position when fitting the tube into the lampholders (2).

The lampholder (2) also comprises test contacts (5) that make possible to check a proper operation of the luminaire on the assembly line.

No reference sign in parentheses in the present text is to be interpreted as being limitative. The verb "comprise" and conjugated forms thereof should is also to be broadly interpreted, i.e. not only as not excluding the presence of items or steps other than those listed after said verb, but also as not excluding the presence of more than one item or step that are listed after said verb and are preceded by the word "a" or "an".

The invention claimed is:

1. A mounting-plate for a luminaire of an elongated type, supporting internal functional components of the luminaire on a first side of the mounting plate and fitting luminaire on a second side of the mounting plate opposite to the first side of the mounting plate, the mounting-plate comprising:

a lampholder-supporting tongue integrally connected to the mounting-plate and cut out of the mounting-plate, having a bending axis proximate to an end of the mounting-plate and perpendicular to a longitudinal axis of the mounting-plate, having an initial position coplanar with and along the longitudinal axis of the mounting-plate, and undergoing a bending rotation from the initial position to an in-use position around the bending axis in a direction towards the end of the mounting-plate; and a lampholder fixed to the lampholder-supporting tongue in the initial position of the lampholder-supporting tongue on the first side of the mounting plate, and fitting the luminaire on the second side of the mounting-plate with the lampholder-supporting tongue in the in-use position.

2. The mounting plate of claim 1, further comprising:

a stamped abutment situated on an opposite side of the bending axis from the lampholder-supporting tongue and centered on the longitudinal axis of the mounting-plate, wherein the stamped abutment extends in a direction of the second side of the mounting plate, and limits the bending rotation of the lampholder-supporting tongue to 90° from its initial position.

3. The mounting plate of claim 1, wherein the luminaire of an elongated type is a fluorescent tube.

4. The mounting plate of claim 1, wherein the internal functional components include a ballast.

5. A method of producing a mounting-plate for a luminaire of an elongated type suitable for supporting internal functional components of the luminaire on a first side of the mounting plate and for fitting a fluorescent tube on a second side of the mounting plate opposite to the first side of the mounting plate, the method comprising:

forming a lampholder-supporting tongue by punching a cut out in the mounting-plate with a main cut that substantially follows a shape of a lampholder, the lampholder-supporting tongue having a bending axis proximate to an end of the mounting-plate and perpendicular to a longitudinal axis along which the lampholder-supporting tongue is integrally connected to the mounting-plate, and an initial position coplanar with and along the longitudinal axis of the mounting-plate;

fixing a lampholder to the lampholder-supporting tongue in the initial position on the first side of the mounting plate; and rotating the lampholder-supporting tongue about the bending axis, towards the end of the mounting plate, and from the initial position to an in-use position perpendicular to the longitudinal axis of the mounting-plate, wherein the lampholder enables the fluorescent tube to be fitted on the second side of the mounting plate with the lampholder-supporting tongue in the in-use position.

6. The method of claim 5 further comprising:

stamping a portion of the mounting-plate to form a stamped abutment on an opposite side of the bending axis from the lampholder-supporting tongue and centered on the longitudinal axis of the mounting-plate, the stamped abutment extending in a direction of the second side of the mounting plate and limiting rotation of the lampholder-supporting tongue.

7. A mounting-plate for a luminaire of an elongated type, supporting internal functional components of the luminaire on a first side of the mounting plate and fitting a fluorescent tube on a second side of the mounting plate opposite to the first side of the mounting plate, the mounting-plate comprising:

a lampholder-supporting tongue having an initial position coplanar with and along a longitudinal axis of the mounting-plate and an in-use position perpendicular to the longitudinal axis of the mounting-plate;

a lampholder fixed to the lampholder-supporting tongue in its initial position, wherein the lampholder-supporting tongue defines a cut out in the mounting-plate having a main cut that substantially follows a shape of the lampholder, the lampholder-supporting tongue (i) being integrally connected to the mounting-plate, (ii) being directly fitted with the lampholder in the initial position on the first side of the mounting plate, and (iii) having a bending axis proximate to an end of the mounting-plate and perpendicular to the longitudinal axis along which the lampholder-supporting tongue is connected to the mounting-plate, the lampholder-supporting tongue with the lampholder fixed thereto undergoing a bending rotation through 90° in a direction towards the end of the mounting plate from (a) the initial position of the lampholder-supporting tongue to (b) the in-use position of the lampholder-supporting tongue wherein the mounting plate enables fitting the lampholder fixed to the lampholder-supporting tongue in the in-use position with the fluorescent tube on the second side of the mounting plate; and a stamped abutment situated on an opposite side of the bending axis from the lampholder-supporting tongue and centered on the longitudinal axis of the mounting-plate, wherein the stamped abutment also extends in a direction of the second side of the mounting plate, and is adapted to limit the bending rotation of the lampholder-supporting tongue to 90°.

8. The mounting plate of claim 7, wherein the lampholder-supporting tongue is defined by the main cut and at least one ancillary cut, the at least one ancillary cut being made along the bending axis.

9. The mounting plate of claim 7, wherein the internal functional components include a ballast.

10. A method of producing a mounting-plate for a luminaire of an elongated type suitable for supporting internal functional components of the luminaire on a first side of the mounting plate and for fitting a fluorescent tube on a second side of the mounting plate opposite to the first side of the mounting plate, the method comprising:

forming a lampholder-supporting tongue by punching that includes a cut out in the mounting-plate having a main cut that substantially follows a shape of a lampholder, wherein the lampholder-supporting tongue has an initial position coplanar with and along a longitudinal axis of the mounting-plate and an in-use position perpendicular to the longitudinal axis of the mounting-plate;

fixing the lampholder to the lampholder-supporting tongue in its initial position, the lampholder-supporting tongue (i) being integrally connected to the mounting-plate, (ii) in the initial position being directly fitted with the lampholder on the first side of the mounting plate, and (iii) having a bending axis proximate to an end of the mounting-plate and perpendicular to the longitudinal axis along which the lampholder-supporting tongue is connected to the mounting-plate, the lampholder-supporting tongue with the lampholder fixed thereto undergoing a bending rotation through 90° in a direction towards the end of the mounting plate from (a) the initial position of the lampholder-supporting tongue to (b) the in-use position of the lampholder-supporting tongue wherein the mounting plate enables fitting the lampholder fixed to the lampholder-supporting tongue in the in-use position with the fluorescent tube on the second side of the mounting plate; and stamping a part of the mounting-plate in order to form a stamped abutment situated on an opposite side of the bending axis from the lampholder-supporting tongue and centered on the longitudinal axis of the mounting-plate, wherein the stamped abutment extends in a direction of the second side of the mounting plate, and is adapted to limit the bending rotation of the lampholder-supporting tongue to 90°.

11. The method of claim 10, wherein the internal functional components include a ballast.

* * * * *